US007331466B2

(12) United States Patent
Stefanik

(10) Patent No.: US 7,331,466 B2
(45) Date of Patent: Feb. 19, 2008

(54) PACKAGING MATERIAL HAVING A CAM LOCK

(75) Inventor: Michael L. Stefanik, Powell, OH (US)

(73) Assignee: Honda Motor Co., Ltd., Tokyo (JP)

( * ) Notice: Subject to any disclaimer, the term of this patent is extended or adjusted under 35 U.S.C. 154(b) by 340 days.

(21) Appl. No.: 11/235,482

(22) Filed: Sep. 26, 2005

(65) Prior Publication Data

US 2007/0068840 A1 Mar. 29, 2007

(51) Int. Cl.
*B65D 81/02* (2006.01)

(52) U.S. Cl. ..... 206/722; 206/1.5; 206/521

(58) Field of Classification Search ..... 206/701, 206/706, 722, 725, 1.5, 521, 591
See application file for complete search history.

(56) References Cited

U.S. PATENT DOCUMENTS

| | | | | |
|---|---|---|---|---|
| 843,419 | A | 2/1907 | Schultz | |
| 1,872,981 | A | 8/1932 | Kuerschner et al. | |
| 2,840,257 | A | 6/1958 | Zeni | |
| 2,925,209 | A | 2/1960 | Wasyluka | |
| 2,933,231 | A | 4/1960 | Colgren et al. | |
| 3,039,667 | A | 6/1962 | Kozlik | |
| 3,064,872 | A | 11/1962 | Skirow | |
| 3,145,834 | A | 8/1964 | Hillger et al. | |
| 3,314,588 | A | 4/1967 | Rodish | |
| 3,358,899 | A | 12/1967 | Wainberg | |
| 3,365,112 | A | 1/1968 | Priest et al. | |
| 3,393,828 | A | 7/1968 | Atkinson | |
| 4,067,492 | A | 1/1978 | Gargan | |
| 4,162,729 | A | 7/1979 | Kaiser et al. | |
| 4,272,008 | A | 6/1981 | Wozniacki | |
| 4,838,445 | A | 6/1989 | Lanius | |
| 4,899,888 | A | 2/1990 | Shawler | |
| 5,242,077 | A | 9/1993 | Smith et al. | |
| 5,429,236 | A * | 7/1995 | Evans | 206/386 |
| 5,555,845 | A | 9/1996 | Flynn | |
| 5,797,487 | A * | 8/1998 | Young | 206/308.2 |
| 5,938,109 | A | 8/1999 | Sainz et al. | |
| 2003/0234195 | A1 | 12/2003 | Earl et al. | |

* cited by examiner

*Primary Examiner*—Jacob K. Ackun, Jr.
(74) *Attorney, Agent, or Firm*—Rankin, Hill, Porter & Clark LLP; Vincent Ciamacco

(57) ABSTRACT

A packaging dunnage including a plurality of packaging columns having a pair of sidewalls, a bottom wall, a plurality of front transverse walls, and a plurality of rear transverse walls that cooperate to define a plurality of cells. Each of the cells is adapted to receive an article for shipment, and is associated with a cam lock assembly. The cam lock assembly includes a lock member that is movable between a first orientation and a second orientation. When the lock member is in the first orientation the cell is adapted to stably receive a first size article. When the lock member is in the second orientation, the cell is adapted to stably receive a second size article. The packaging dunnage is further adapted to receive articles having sizes between the first and second sizes.

17 Claims, 6 Drawing Sheets

PACKAGING MATERIAL HAVING A CAM LOCK

BACKGROUND OF THE INVENTION

1. Field of the Invention

The present invention relates to packaging dunnage and shipping materials and, more particularly, toward such packaging dunnage and methods that are adapted to receive different sized parts.

2. Description of Related Art

In shipping sensitive electronic components, it is necessary to secure the parts against movement and excessive vibration. Conventionally, this is accomplished by custom designing shipping containers and packaging materials for each electronic component. However, this significantly adds to the shipping costs, especially when electronic components of varying sizes are shipped. Further, as product dimensions change between models, new packaging materials must be developed, which is expensive and time consuming.

Therefore, there exists a need in the art for a packaging dunnage that is adapted to accommodate similar articles having different sizes, and such packaging dunnage that is adapted for standardized shipping containers. There further exists a need in the art for packaging dunnage that may be readily changed to accommodate changes in article size as new article models are developed.

SUMMARY OF THE INVENTION

The present invention is directed toward a packaging dunnage that is adapted to accommodate and securely receive similar articles having different sizes. The present invention is further directed toward such packaging dunnage that is received in standardized shipping containers.

In accordance with the present invention, the packaging dunnage includes a plurality of packaging columns, each of the columns including a plurality of cells. The columns are defined by relatively rigid sidewalls that are secured to one another in a rectangular shape. The columns include relatively rigid transverse walls that separate the columns into a plurality of cells. Each of the cells includes a rotatable cam lock member that is mounted upon a shaft extending between the sidewalls of the packaging column. The cam lock has an irregular or semi-elliptical peripheral shape specially designed to change a spacing between a surface of the cam lock and one of the transverse walls facing the cam lock surface as the cam lock is rotated.

In further accordance with the present invention, the cam lock is movable between a first rotary position in which a side of the cam lock facing one of the transverse walls is at a first distance from the one transverse wall, and a second rotary position in which the side of the cam lock facing the one transverse wall is at a second distance from the one transverse wall. The first distance is essentially equal to an associated dimension of a first size article that is received in the cell, and the second distance is essentially equal to an associated dimension of a second size article that is received in the cell. Accordingly, by rotating the cam lock between the first and second rotary positions, similar articles of different sizes can be securely received in the cell.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
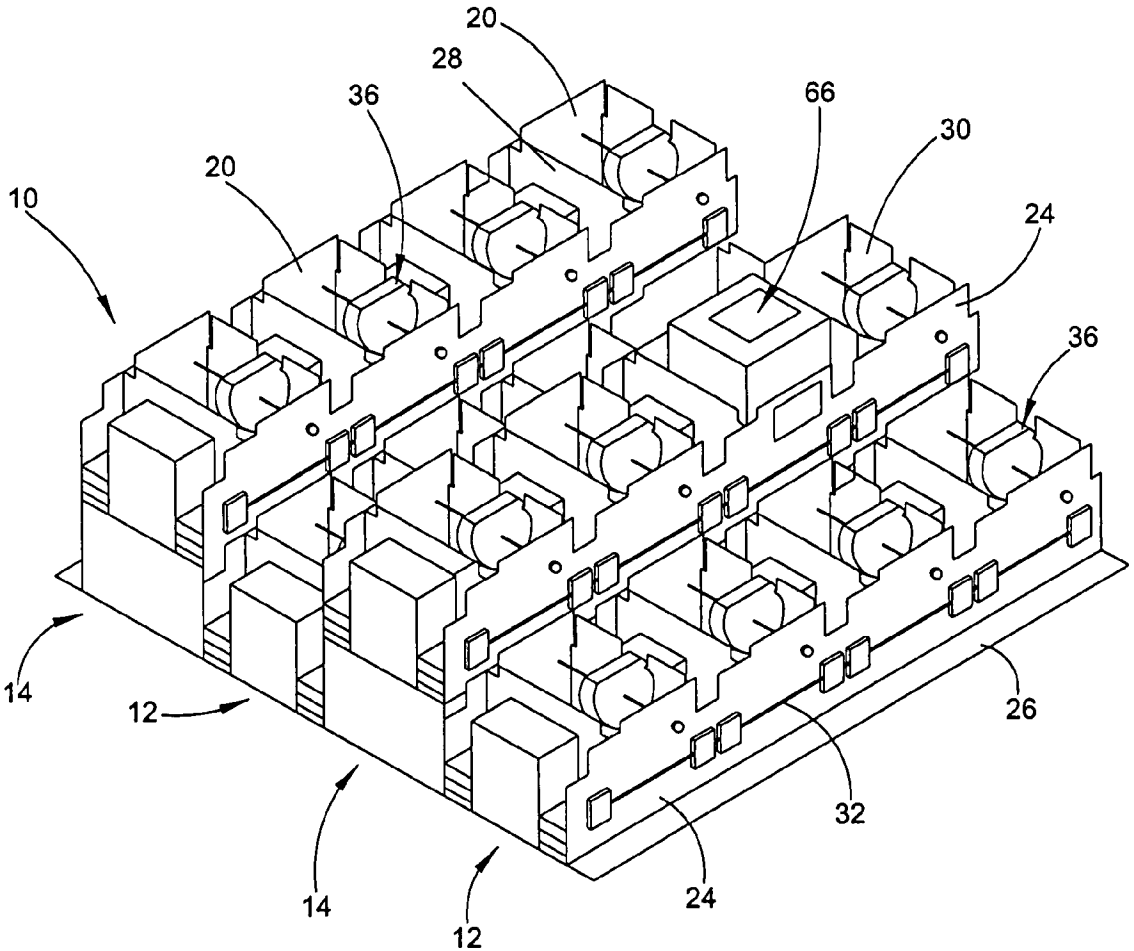
FIG. 1 is a perspective view of a portion of a packaging dunnage incorporating the present invention.

With reference to FIG. 1, a packaging dunnage 10 incorporating a cam lock assembly 36 of the present invention is shown to include a series of packaging columns 12, 14, each of which comprise a series of cells 20. In the illustrated embodiment, the packaging dunnage 10 is adapted for receipt in a standardized shipping container, which is sometimes referred to in the shipping art as an A1-style plastic container. Such A1-style containers are known to have standardized dimensions of 48 in.×45 in.×25 in.

Each packaging column preferably is rectangular in length and adapted to be received in the A1-style container. As such, each packaging column 12, 14 will have a maximum length of about 48 inches, a maximum height of about 24-25 inches, and a maximum width of about 11.25 inches.

Each packaging column 12, 14 has a pair of sidewalls 24 and a bottom wall 26. Preferably, each of the walls is formed from corruplast, which is a well known relatively rigid, lightweight, and durable corrugated plastic material. Naturally, other materials are known in the art and may be used to form the walls without departing from the scope and spirit of the present invention.

The sidewalls 24 preferably integrally provide mounting tabs 24*a* that receive a reinforcing bar 32, which serves to strengthen or stiffen the associated column 12, 14 against deformation. It will be appreciated that the basic structure of the columns 12, 14 described to this point is generally known to those skilled in the art, and will not be described further hereinafter.

It is noted the columns 12, 14 illustrated in FIG. 1 are shown as having different heights, whereby a first column 12 is relatively shorter than a second column 14, and that these columns 12, 14 are placed next to one another so as to stagger the vertical location of laterally adjacent cells 20. Providing adjacent columns at different vertical heights facilitates placement of articles therein. Preferably, the relatively shorter columns 12 are loaded with articles before the adjacent taller columns 14. Further, relatively taller columns 14 are preferably unloaded before the adjacent relatively shorter columns 12. As will be appreciated by those skilled in the art, this loading/unloading procedure minimizes any interference problems created by the close proximity of the cells of adjacent columns 12, 14.

In the packaging dunnage 10 illustrated in FIG. 1, sixteen possible cells 20 are provided. However, it is noted that one of the cells 20 has been designated as a storage compartment 66 wherein various replacement parts may be disposed. A top surface of the storage compartment 66 also preferably includes a graphical illustration of the preferred loading/unloading sequence for the cells 20, described hereinbefore. Providing such replacement parts permits damaged cam lock assemblies, described hereinafter, to be readily repaired and placed back into service. Accordingly, in the illustrated embodiment of the packaging dunnage 10 fifteen cells are available to receive articles for shipment.

Figures 2A, 2B:
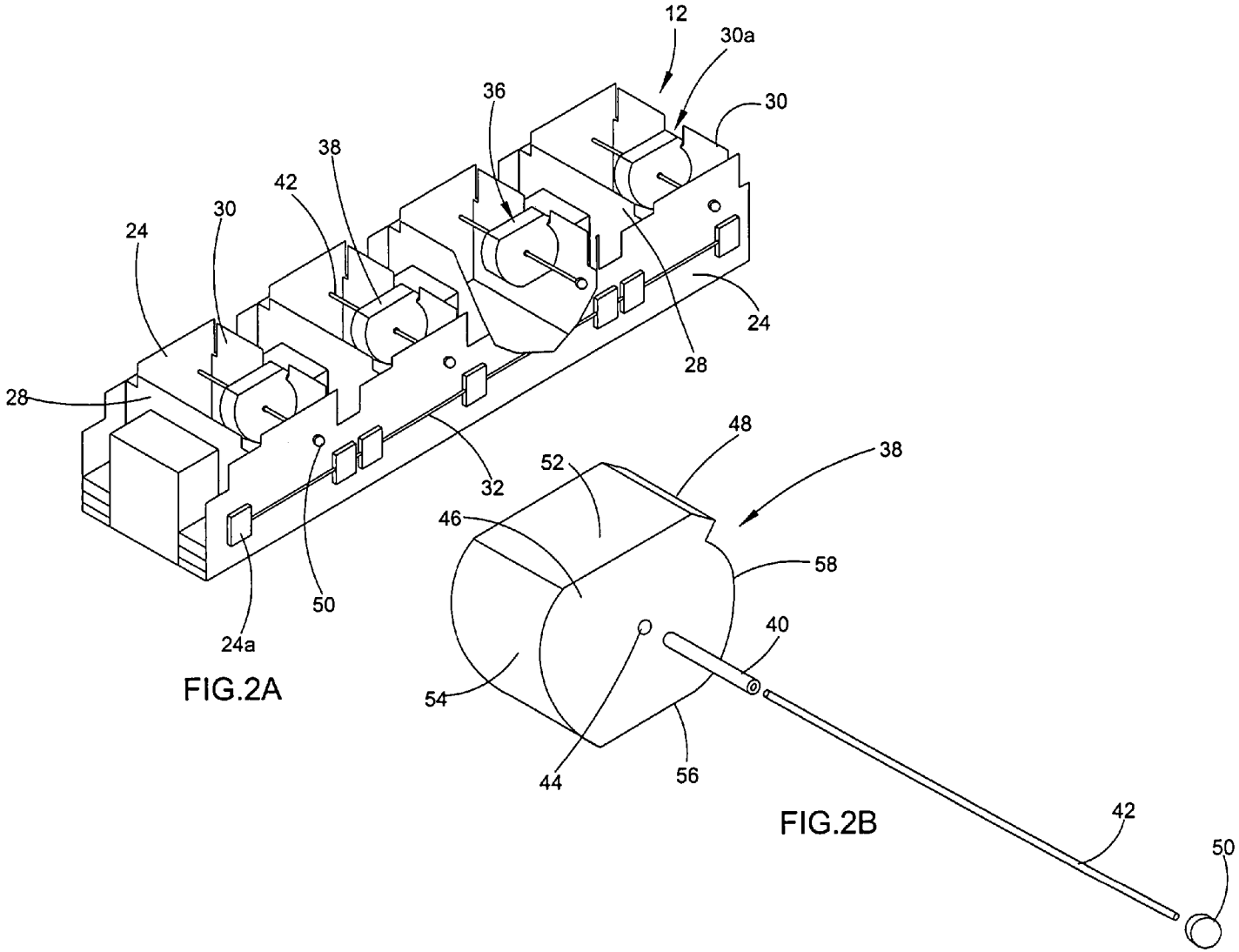
FIG. 2A is a perspective view of a packaging column incorporating the present invention, with portions of one sidewall broken away.
FIG. 2B is an exploded perspective view of a cam lock assembly according to the present invention.

With reference to FIG. 2A, a representative packaging column 12 according to the present invention is illustrated, and is shown to further include a series of transverse walls 28, 30. The transverse walls 28, 30 extend between the sidewalls 24, as illustrated, and are referred to hereinafter as a front transverse wall 28 and a rear transverse wall 30. The sidewalls 24, bottom wall 26, one rear transverse wall 30 and one front transverse wall 28 cooperate to define the four individual cells 20 for each column 12, 14. Each rear transverse wall 30 has a notched recess 30*a* formed therein that is adapted to receive a portion of a cam lock member 38, describe hereinafter.

Preferably, the front transverse wall 28 for each cell 20 is spaced from the rear transverse wall 30 of the next adjacent cell, and this space receives a reinforcing block 34. The reinforcing block 34 has sufficient structural rigidity to support the front and rear transverse walls 28, 30 so as to prevent their deformation in use, as will be appreciated by those skilled in the art and apparent from the following description. Preferably, the reinforcing block 34 is made from a closed cell foam material, although other materials may be used interchangeably.

A cam lock assembly 36 is provided for each cell 20. With respect to FIG. 2A, the cam lock assembly 36 includes a cam lock member 38, a cylindrical sleeve 40, and a shaft 42. The cam lock member 38, which is preferably formed from a relatively dense, closed cell foam material, defines an offset bore 44, a pair of generally planar sidewalls 46, an outwardly extending tongue 48, and a somewhat irregular or semi-elliptical peripheral surface.

The bore 44 extends through the sidewalls 46 and receives the cylindrical sleeve 40 in a press-fit fashion. The cylindrical sleeve 40, which preferably is formed from a metal such as aluminum, serves as a bushing and slidably receives the shaft 40 so as to rotatably mount the cam lock member 38 to the shaft 42. Opposite ends of the shaft 42 extend through the sidewalls 24 of the packaging column 12, 14, and are preferably retained thereon by push nuts 50 or the like.

It will be appreciated that the cam lock member 38 is especially adapted to be efficiently formed by molding. As such, production of the cam lock member 38 is cost effective, and modifications to the size and/or peripheral surface thereof, as may be desired to accommodate changes in the article dimensions, described hereinafter, may be economically provided. Naturally, the cam lock member 38 may be formed by other methods, such as extrusion, without departing from the scope and spirit of the present invention.

Figure 3:
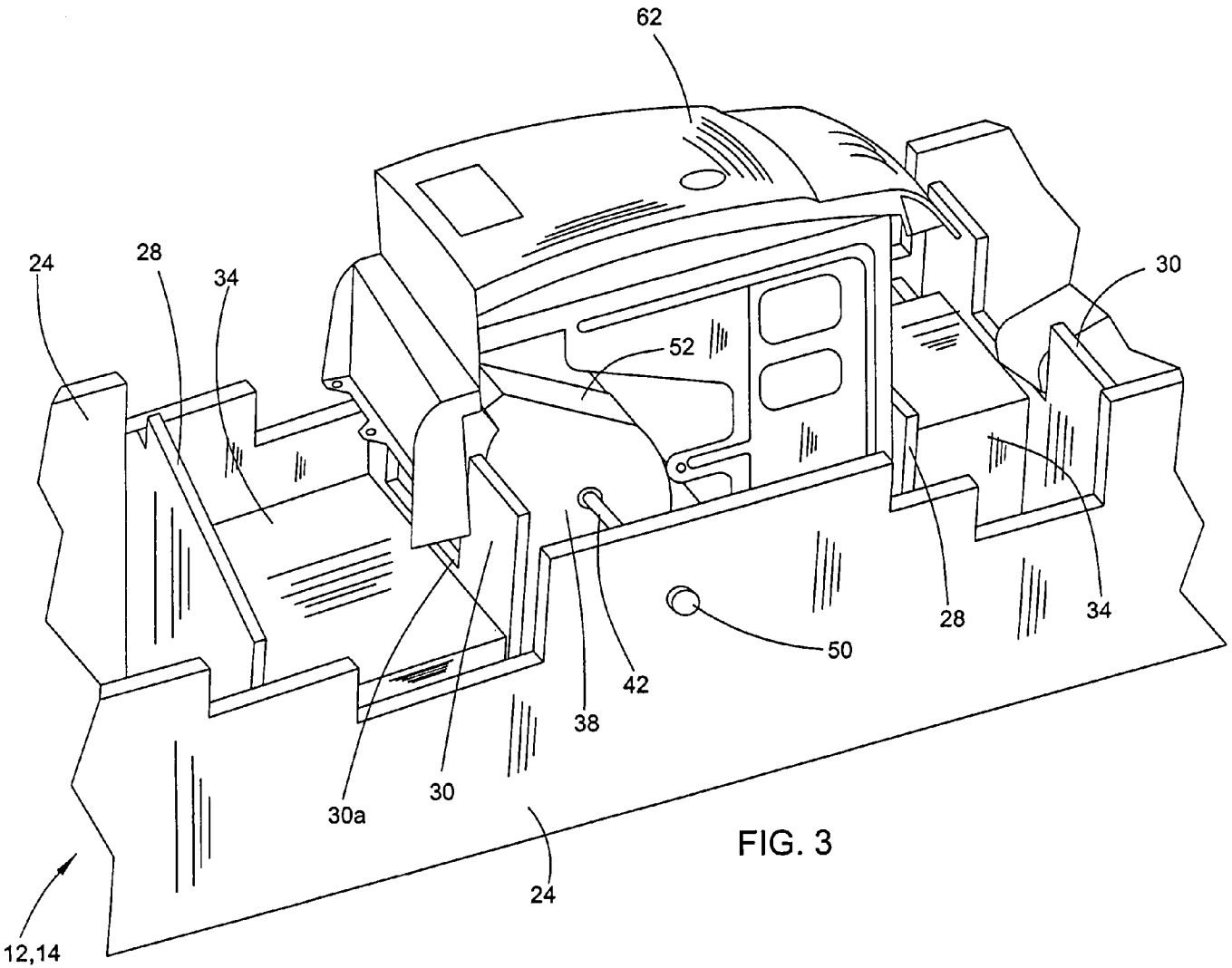
FIG. 3 is an enlarged perspective view illustrating insertion of a first size article into a cell of the packaging dunnage, with a cam lock according to the present invention in a first orientation.

The cam lock member peripheral surface, which may be thought of as being semi-elliptical in shape, includes a flat first surface 52 and a curved second surface 54. The cam lock member peripheral surface further includes a planar surface 56 opposite the flat first surface 52, and a rounded surface 58 opposite the curved second surface 54. A support surface 60 is provided by the extending tongue 48, and serves to engage the rear transverse wall 30 when the cam lock member 38 is in a first orientation (FIG. 3). More specifically, the extending tongue 48 is adapted to fit within the notched recess 30*a* of the rear transverse wall 30, as will be apparent from the following description.

In the illustrated embodiment, each cell 20 is adapted to receive an article for shipment, and to stably support the article. More specifically, each cell 20 is specially adapted to receive similar articles having slightly different dimensions or sizes by frictionally receiving the article between the cam lock member 38 and the front transverse wall 28 while the cam lock member 38 frictionally engages the article and the rear transverse wall 30. FIGS. 3-6 illustrate use of the invention in securing two differently sized Central Module Units (CMU). Such CMU's are integrated electronic components that are to be installed in a vehicle dashboard, and typically include various controls for a vehicle climate control system as well as one or more audio and video components, such as a radio, CD player, and a navigation system and associated video screen. Generally, since the CMU must be installed in a predetermined space in the vehicle dashboard, the outer face of each CMU, regardless of the components installed therein, is generally identical. However, there may be small differences in the interior vertical height (as viewed when installed in the vehicle dashboard and sometimes referred to in the art as an 'in-car position') of different CMU's due to the different components that may be included in the CMU.

Figure 5:
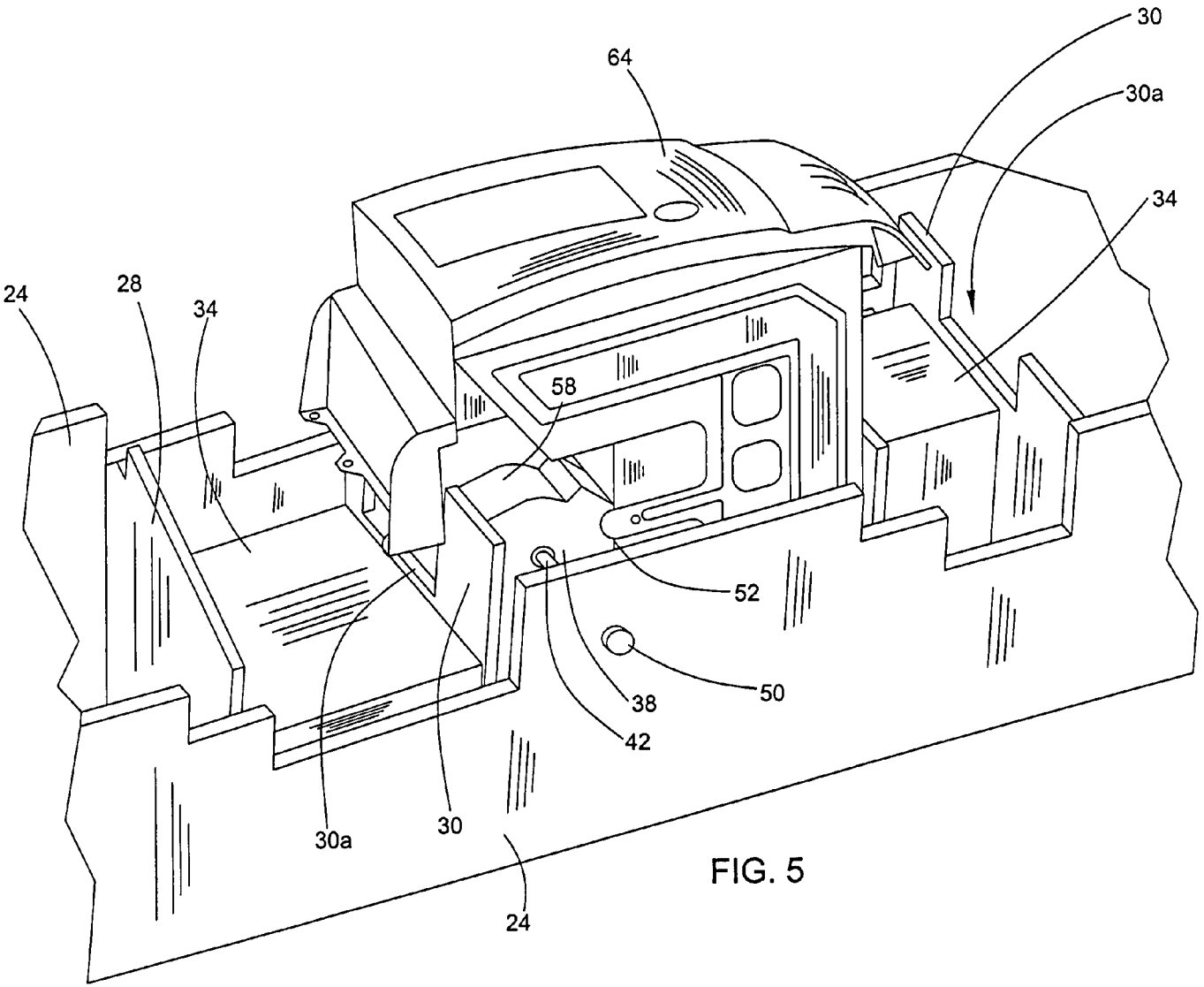
FIG. 5 is an enlarged perspective view illustrating insertion of a second size article into a cell of the packaging dunnage, with the cam lock according to the present invention in a second orientation; and, FIG. 6 is a cross sectional view of the cell of FIG. 5, with the second size article received in the cell.
Figure 6:
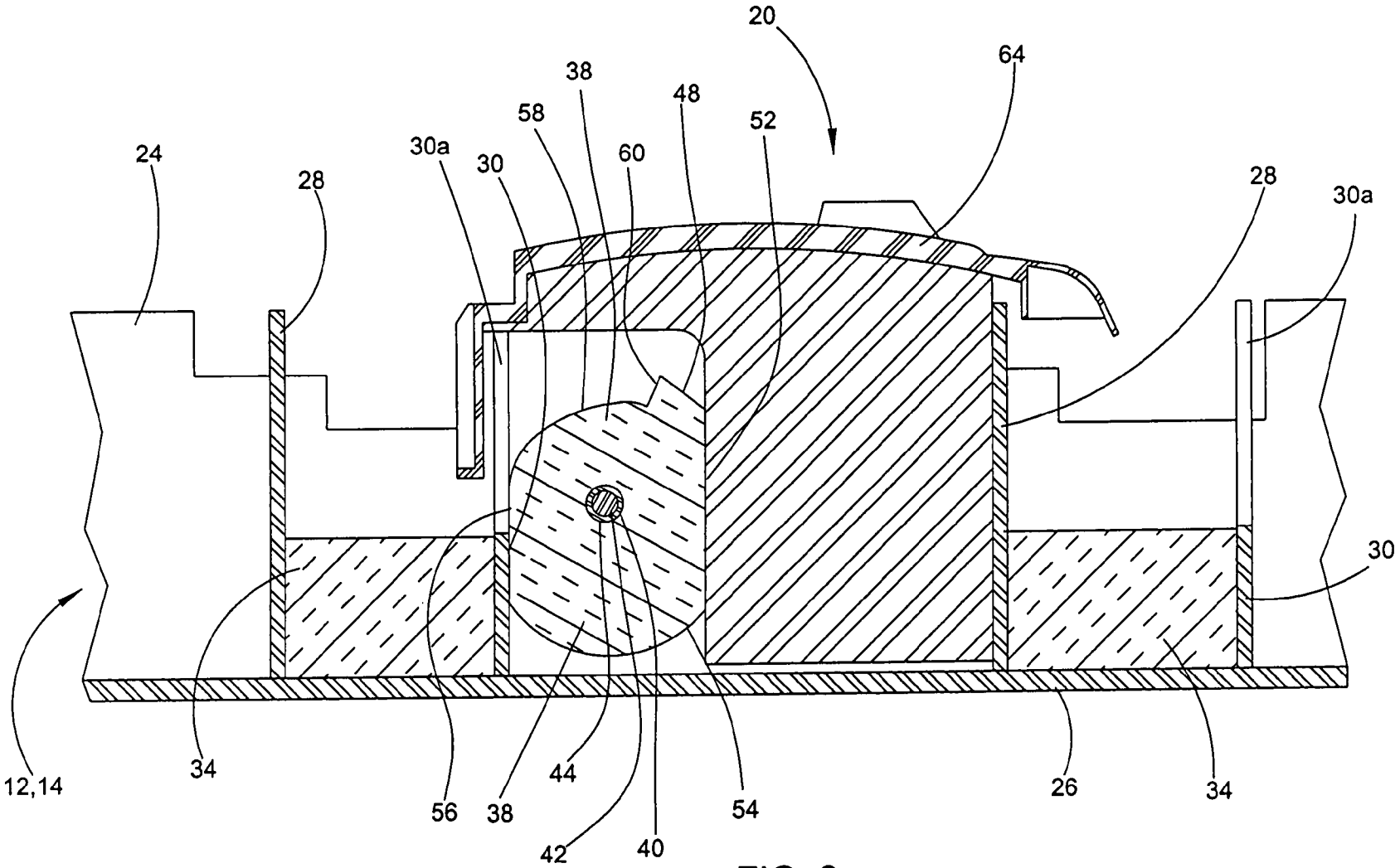

For example, a first CMU having a radio and a single disc CD player may have a first vertical height dimension, while a second CMU having a radio and a six-disc CD player may have a second vertical height dimension, while a third CMU having a radio, a six-disc CD player and a navigation system may have a third vertical height dimension. The differences in height between the first and second, and the second and third CMU's may be small (e.g., 0.125 inches) from a shipping perspective, and may be absorbed by the inherent resilience or compressibility of the packaging materials surrounding the CMU. However, the difference in height between the first and third CMU is significant (e.g., 0.25 inches) and has heretofore made shipping of the first and third CMU in common, identical packaging materials impossible. However, the present invention accommodates such differences in height, as will be apparent from the following description and with reference to the drawings, wherein FIGS. 3-4 show placement of the first CMU (i.e., including radio and single disc CD player) in a cell 20 and FIGS. 5-6 show placement of the third CMU (i.e., including radio, six-disc CD player, and navigation unit) in a cell 20.

It is further noted that some CMU's (hereinafter called custom or premium CMU's) include additional add-on component blocks or boxes that protrude from the rear of the CMU and heretofore have made shipping of such premium CMU's problematic. However, with the present invention, the cam lock member 38 of the present invention may be adjusted laterally along the length of the shaft 42 so as to accommodate such special situations and thereby seamlessly permit stable and secure shipping of such premium CMU's.

With reference to FIG. 3, a first CMU 62 is shown disposed partially within the host cell 20 just prior to being pushed down into the accommodating space between the cam lock member curved second surface 54 and the front transverse wall 28. In order to receive the first CMU 62, the cam lock member 38 is disposed in a first orientation in which the support surface 60 of the extending tongue 48 is received within the notched recess 30*a* of the associated rear transverse wall 30 and engaged with an upwardly facing surface of the rear transverse wall 30. As such, the cam lock member 38 and the associated rear transverse wall 30 cooperate to properly orient the cam lock member curved second surface 54 to receive the first CMU 62. As mentioned previously, should the first CMU be a custom CMU having additional components (not shown) that interfere with the proper rotary positioning of the cam lock member 38, the cam lock member 38 may be slid along the shaft 42 to a position out of engagement with such additional components.

Figure 4:
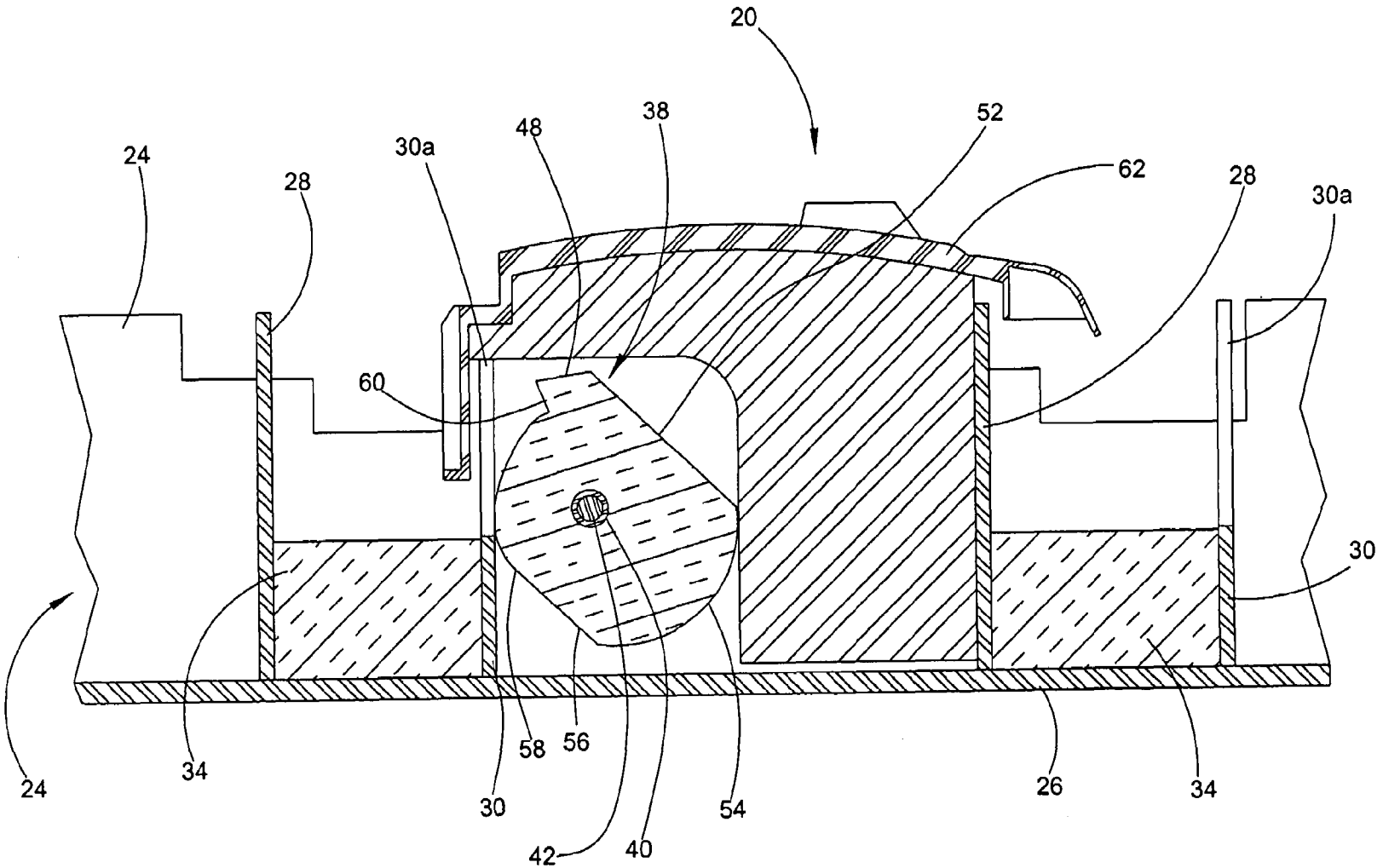
FIG. 4 is a cross sectional view of the cell of FIG. 3, with the first size article received in the cell.

FIG. 4 shows the cell 20 following insertion of the first CMU 62 therein. As will be appreciated, during insertion of the first CMU 62 into the cell 20, the first CMU 62 engages the curved second surface 54 of the cam lock member 38, causing the cam lock member 38 to rotate (clockwise in the drawing) such that the extending tongue 48 is moved out of engagement with the rear transverse wall 30 of the packaging column 12, 14. The spacing between the cam lock member second surface 54 and the front transverse wall 28 is chosen so as to securely frictionally receive the first CMU 62 therein. As such, and keeping in mind that the cam lock member 38 may be made of a slightly compressible closed cell foam material, the at-rest space (i.e., prior to insertion of the first CMU) between the cam lock member second surface 54 and the front transverse wall 28 may be equal to, or slightly smaller than, the relevant vertical height dimension of the first CMU 62 to be received therebetween. In this position, one surface of the cam lock member 38 is in engagement with the rear transverse wall 30 and the opposite surface of the cam lock member 38 is in engagement with the first CMU 62, as illustrated. Accordingly, the first CMU 62 is frictionally held between the cam lock member 38 and the rear transverse wall 30, while the cam lock member 38 is in frictional engagement with the first CMU 62 and the front transverse wall 28.

FIG. 5 schematically illustrates a third CMU 64 disposed partially within the host cell 20 just prior to being pushed down into the accommodating space between the cam lock member flat first surface 52 and the front transverse wall 28. In order to receive the third CMU 64, the cam lock member 38 is disposed in a second orientation (rotated approximately 90-120° relative to the position shown in FIG. 3) in which the extending tongue 48 is directed upwardly, and in which the flat first surface 52 is substantially parallel to and facing toward the front transverse wall 28.

FIG. 6 is a cross-sectional view schematically showing the cell 20 following insertion of the third CMU 64 therein. As illustrated, the third CMU 64 has a height dimension that closely matches the spacing between the flat first surface 52 and the front transverse wall 28 such that the third CMU 64 is snugly and stably received therebetween by friction. In this regard, it is again noted that the at-rest space (i.e., prior to insertion of the third CMU 64) between the cam lock first surface 52 and the front transverse wall 28 may be equal to, or slightly smaller than, the height dimension of the third CMU 64 to be received therebetween. In this position, one surface of the cam lock member 38 is in engagement with the rear transverse wall 30 and the opposite surface of the cam lock member 38 is in engagement with the third CMU 64, as illustrated. Accordingly, the third CMU 64 is frictionally held between the cam lock member 38 and the rear transverse wall 30, while the cam lock member 38 is in frictional engagement with the third CMU 64 and the front transverse wall 28.

As mentioned previously, should the third CMU be a custom CMU having additional components (not shown) that interfere with the proper rotary positioning of the cam lock member 38, the cam lock member 38 may be slid along the shaft 42 to a position out of engagement with such additional components.

Further, as noted hereinbefore, there exists a second CMU (not shown) that has a vertical height dimension that is relatively larger than the vertical height dimension of the first CMU 62 and relatively smaller than the vertical height dimension of the third CMU 64. Due to the compressible nature of the cam lock member 38, the second CMU may be safely received within cell 20 with the cam lock member 38 in either of the previously described first and second orientations.

Accordingly, with the present invention, differently sized articles can be safely and securely received within a cell 20 of a packaging dunnage 10. By simply rotating the cam lock member 38 between the first and second orientations the cells 20 are transformed from having a first sized space to accommodate a first size article to a second sized space to accommodate a second size article, such that differently sized articles may be conveniently and safely received in the cells 20 of the packaging column 12, 14.

In this regard it will be appreciated that the particular peripheral shape of the cam lock member 38 is exemplary and the present invention is not limited thereto. Rather, the cam lock member peripheral shape may be readily adapted to the particular articles being shipped, and may be easily changed as the size of such articles changes. Moreover, the present invention is not limited to the particular articles (i.e., CMU's) described herein, but rather may be adapted, by one skilled in the art, to many different articles.

In light of the foregoing, it will be appreciated that the present invention is capable of numerous modifications and changes in dimensions or configurations without departing form the scope and spirit of the present invention, as embodied in the claims attached hereto.

What is claimed is:

1. A packaging dunnage, comprising:

a packaging column having a pair of sidewalls, a bottom wall, a plurality of front transverse walls, and a plurality of rear transverse walls that cooperate to define a plurality of cells, each of said cells being adapted to receive an article for shipment;

a cam lock assembly associated with each cell and comprising a lock member that is movable between a first orientation and a second orientation, wherein, when said lock member is in said first orientation said cell is adapted to stably receive a first article having a first dimension and wherein, when said lock member is in said second orientation, said cell is adapted to stably receive a second article having a second dimension, and wherein said first dimension is different than said second dimension.

2. The packaging dunnage according to claim 1, wherein said cam lock assembly further includes a shaft that extends between said sidewalls and rotatably supports said lock member.

3. The packaging dunnage according to claim 1, wherein said rear transverse wall includes a notch that receives a portion of said lock member when said lock member is positioned to receive said first article.

4. The packaging dunnage according to claim 1, wherein said lock member is rotated to move between said first and second orientations.

5. The packaging dunnage according to claim 1, wherein said lock member includes a first peripheral surface and a second peripheral surface, and wherein said first peripheral surface faces toward said front transverse wall when said lock member is in said first orientation and wherein said second peripheral surface faces toward said front transverse wall when said lock member is in said second orientation.

6. The packaging dunnage according to claim 5, wherein, when said locking member is in said first orientation, the first peripheral surface is spaced a first distance from the front transverse wall, and when said lock member is in said second orientation, the second peripheral surface is spaced a second distance from the front transverse wall.

7. The packaging dunnage according to claim 6, wherein the first distance is less than or equal to the first dimension, and wherein the second distance is less than or equal to the second dimension.

8. The packaging dunnage according to claim 7, wherein said cam lock assembly further includes a shaft that extends between said sidewalls and rotatably supports said lock member.

9. The packaging dunnage according to claim 8, wherein said rear transverse wall includes a notch that receives a portion of said lock member when said lock member is positioned to receive said first article.

10. The packaging dunnage according to claim 9, wherein said lock member is rotated to move between said first and second orientations.

11. The packaging dunnage according to claim 9, wherein said lock member is slidably movable along said shaft so as to be repositioned to accommodate characteristics of one of said articles.

12. A method for securing an article for shipment in a packaging dunnage, comprising the steps of:

providing a packaging dunnage including a plurality of cells, each of said cells having a cam lock assembly associated therewith and being at least partially defined by a pair of sidewalls, a front transverse wall, and a rear transverse wall, each of said cam lock assemblies including a lock member that is movable between a first orientation and a second orientation, wherein, when said lock member is in the first orientation a first surface of the lock member is facing the associated front transverse wall and spaced a first distance from said associated front transverse wall so as to be adapted to receive a first size article therebetween and, when said lock member is in the second orientation a second surface of the lock member is facing the associated front transverse wall and spaced a second distance from said associated front transverse wall so as to be adapted to receive a second size article therebetween;

determining which of the first and second size articles is to be received in each of said plurality of cells and, for each cell:

if said first size article is to be received in said cell:

moving said lock member into said first orientation; and, inserting said first size article into the space between the first surface and the front transverse wall;

if said second size article is to be received in said cell:

moving said lock member into said second orientation; and, inserting said second size article into the space between the second surface and the front transverse wall.

13. The method according to claim 12, wherein said cam lock assembly further includes a shaft upon which said lock member rotatably mounted, and said lock member is rotatably moved between said first and second orientations.

14. The method according to claim 13, comprising the further step of slidably repositioning said lock member along said shaft so as to accommodate structural characteristics of the article to be received.

15. The method according to claim 12, wherein said packaging dunnage includes a first packaging column and a second packaging column, each of said packaging columns including a plurality of cells, and wherein said first packaging column is relatively shorter than said second packaging column, comprising the further step of:

inserting articles in the cells of the first packaging column before inserting articles in the cells of the second packaging column.

16. The method according to claim 15, wherein said cam lock assembly further includes a shaft upon which said lock member rotatably mounted, and said lock member is rotatably moved between said first and second orientations.

17. The method according to claim 16, comprising the further step of slidably repositioning said lock member along said shaft so as to accommodate structural characteristics of the article to be received.

* * * * *